US006597322B2

(12) United States Patent
Takenoshita

(10) Patent No.: US 6,597,322 B2
(45) Date of Patent: Jul. 22, 2003

(54) PRIMARY RADIATOR, PHASE SHIFTER, AND BEAM SCANNING ANTENNA

(75) Inventor: Takeshi Takenoshita, Kyoto (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 10/059,523

(22) Filed: Jan. 29, 2002

(65) Prior Publication Data

US 2002/0101386 A1 Aug. 1, 2002

(30) Foreign Application Priority Data

Jan. 29, 2001 (JP) ..... 2001-020620

(51) Int. Cl.[7] ..... H01Q 13/10; H01Q 13/00
(52) U.S. Cl. ..... 343/771; 343/772
(58) Field of Search ..... 343/770, 771, 343/757, 778, 772, 767

(56) References Cited

U.S. PATENT DOCUMENTS 5,245,301 A 9/1993 Portrait et al. ..... 333/256
6,008,775 A * 12/1999 Bobowicz et al. ..... 343/771
6,049,311 A * 4/2000 Alexanian ..... 343/771
6,127,985 A * 10/2000 Guler ..... 343/771

FOREIGN PATENT DOCUMENTS

JP 5-183302 7/1993 ..... H01P/1/06
JP 2001-127524 5/2001 ..... H01Q/3/14

* cited by examiner

*Primary Examiner*—Hoang Nguyen
(74) *Attorney, Agent, or Firm*—Hogan & Hartson, LLP

(57) ABSTRACT

A primary radiator comprises a base part in an upper surface of which a groove having a width of ½ to 1/1 of the signal wavelength of a high frequency signal and a depth of about ¼ of the signal wavelength is formed as a waveguide for the high frequency signal, and a moving part which is placed in such a manner as to cover the groove, and which includes a coupling window for an electromagnetic wave of the high frequency signal and a reflecting member that is formed on a lower surface of the moving part in such a manner as to fit in a cross section of the groove and is positioned away from the coupling window by ⅛ to 1/1 of the guide wavelength of the high frequency signal.

12 Claims, 10 Drawing Sheets

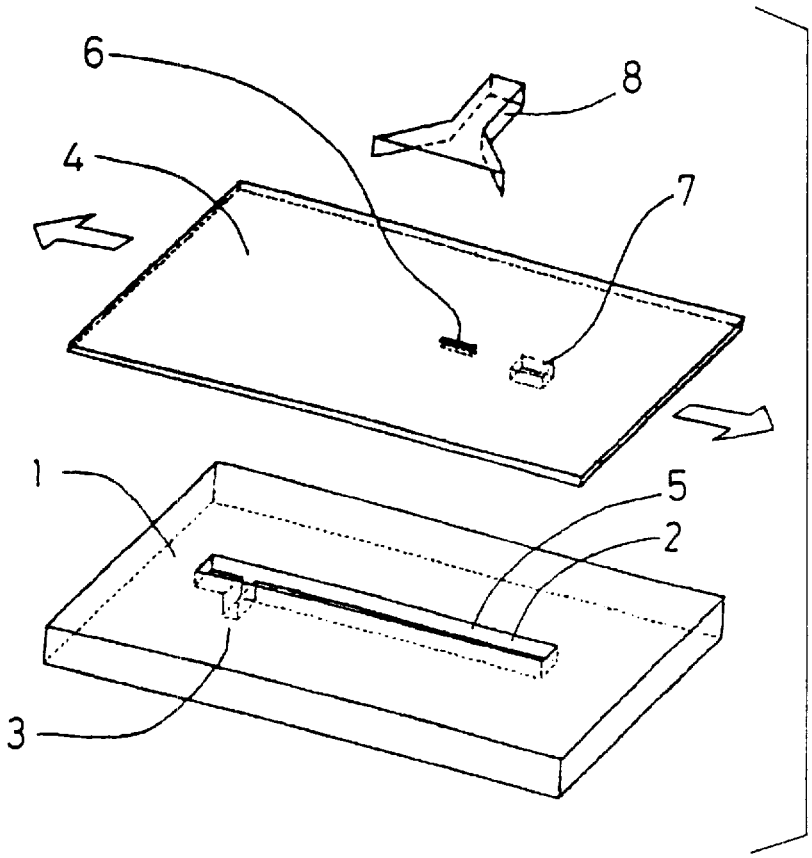
FIG.1
FIG.2
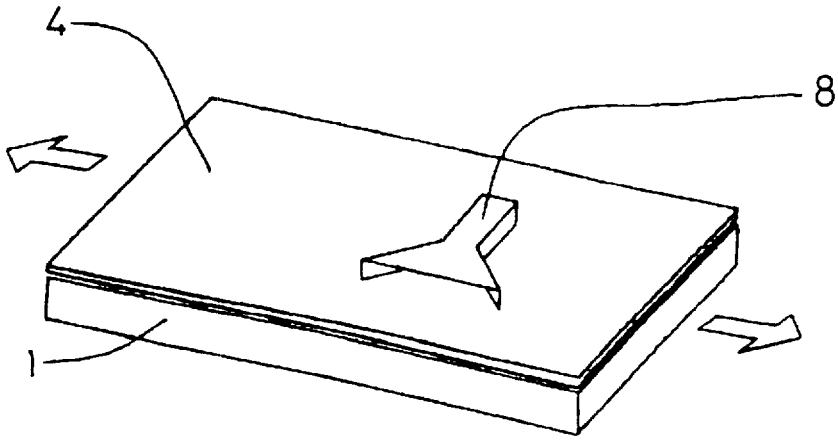

PRIMARY RADIATOR, PHASE SHIFTER, AND BEAM SCANNING ANTENNA

BACKGROUND OF THE INVENTION

1. Field of the Invention

The present invention relates to a primary radiator for use in a beam scanning antenna in the microwave or millimeter wave band, and more particularly to a primary radiator capable of moving an electromagnetic wave output part in a two dimensional plane without causing unwanted leakage of a high frequency signal, and a phase shifter and beam scanning antenna using the same.

2. Description of the Related Art

A variety of beam scanning antennas using electromagnetic beams in the microwave or millimeter wave band have been proposed in the prior art. There are two major methods of beam scanning: mechanical beam scanning and electronic beam scanning.

In the mechanical beam scanning method, beam scanning is performed by moving a portion of an antenna that has a given directionality or by moving the entire antenna. According to this method, the construction is simple because usually one antenna is moved to scan one beam. However, the provision of the mechanical movement involves the problem that high speed beam scanning is difficult in the case of a large antenna.

The electronic beam scanning is classified into two types: one that uses an array antenna constructed from an array of antenna elements and scans the beam by controlling the phases of the high frequency signals fed to the respective elements by means of phase shifters, and the other that uses a plurality of antennas having different directionalities and scans the beam by switching among them by means of switches. These types of beam scanning can accomplish high speed beam scanning because they do not require the provision of mechanical movements, but the problem is that the phase shifters and the switches are expensive, limiting the use of these types of antennas.

Latching ferrite phase shifter are commonly used as the phase shifters for electronic beam scanning type antennas. Since this type of phase shifter usually controls the phase in eight steps, i.e., in increments of 45 degrees, there arises the problem that, with this type, the phase cannot be controlled continuously. It is also said that this type of phase shifter has the problem that the response time is slow compared with the switch.

On the other hand, PIN diodes are commonly used as the switches for switching among the antennas. However, the PIN diode is a switch that switches between open and closed states, and therefore has the problem of large insertion loss. Another problem is high cost, because as many switches are required as there are antennas.

In recent years, with advances in semiconductor fabrication technology, phase shifters and switches have begun to be fabricated in MMIC (Microwave Monolithic Integrated Circuit) form, promising to increase the performance of beam scanning antennas, but since the MMIC is also expensive, there is a need to provide an inexpensive phase shifter that can control the phase.

In view of this, the applicant has proposed in Japanese Unexamined Patent Publication JP-A 2001-127524 (2001) a beam scanning antenna comprising a primary radiator placed between two parallel metal plates, a wave collector constructed from a dielectric lens or a reflector or the like, and a plurality of slots formed in one of the parallel plates. According to this beam scanning antenna, a high frequency spherical wave signal radiated from the primary radiator propagates through the space between the parallel plates, and is converted into a plane wave by the wave collector. Further, the positional relationship between the primary radiator and the wave collector is varied and, using this as a phase shifter, the tilting of the electromagnetic wave phase can be controlled. The beam can be scanned by externally radiating the high frequency signal, whose phase has been controlled by the phase shifter, directly through the slots formed in one of the parallel plates, or by feeding the high frequency signal to another antenna element mounted outside the slots. This beam scanning antenna can be fabricated at low cost because it is constructed using the parallel plates, the wave collector forming the phase shifter, and the primary radiator.

The beam scanning antenna proposed in JP-A 2001-127524 by the applicant requires that either the wave collector or the primary radiator or both be moved to vary the positional relationship between the wave collector and the primary radiator. Both the wave collector and the primary radiator are placed between the parallel plates, and the high frequency spherical wave signal radiated from the primary radiator, after being converted into the plane wave by the wave collector, is fed to the slots acting as radiating elements or feed windows to the outside. Therefore, to allow the wave collector or the primary radiator to move, a prescribed gap must be provided between each parallel plate and the wave collector or the primary radiator.

However, when a gap is provided between each parallel plate and the wave collector, the sum of the high frequency signal converted into the plane wave by the wave collector and the high frequency spherical wave signal passed unchanged through the gap between each parallel plate and the wave collector is fed to the slots. In this case, the spherical wave and the plane wave arrive out of phase at the slot feed point; as a result, in some instances, the phase of the high frequency signal fed to the slots may be disturbed.

On the other hand, when a gap is provided between each parallel plate and the primary radiator, since the wave source consists only of the primary radiator which has directionality, the phase is relatively unaffected. However, a high frequency transmitter/receiver is usually connected to the primary radiator, and the transmitter/receiver is a precision component and relatively large in weight; hence the problem that moving the primary radiator for beam scanning tends to increase the chance of transmitter/receiver failure.

SUMMARY OF THE INVENTION

The present invention has been devised to overcome the above-outlined problems of the prior art, and an object of the invention is to provide a phase shifter comprising a wave collector and a primary radiator, and a primary radiator for use in a beam scanning antenna that uses such a phase shifter, wherein the primary radiator is constructed as a component structurally independent of a transmitter/receiver connected to it so that only the primary radiator can be moved without moving the transmitter/receiver, thereby achieving the construction of an inexpensive, high-reliability, and high-performance phase shifter and beam scanning antenna using such a primary radiator.

Another object of the invention is to provide a phase shifter that is constructed by arranging the above primary radiator and wave collector between parallel plates, and that can control the phase continuously by varying the positional relationship between the primary radiator and the wave collector.

A further object of the invention is to provide a beam scanning antenna which includes slots formed in one of parallel plates that form part of the phase shifter constructed using the above primary radiator, and which scans the beam by radiating a high-frequency signal directly through the slots after controlling the phase by the wave collector, or by feeding through the slots the high frequency signal to another antenna that is mounted outside the parallel plates.

The inventor has conducted extensive studies on the previously described problems and has found that the problems associated with the prior art can be solved by employing the following configuration.

The invention provides a primary radiator comprising:

a base part in an upper surface of which a groove having a width of ½ to 1/1 of signal wavelength of a high frequency signal and a depth approximately equal to ¼ of the signal wavelength, and whose inner wall is formed of an electrically conductive material, is formed as a waveguide for the high frequency signal; and a moving part formed of an electrically conductive material and placed above the upper surface of the base part in such a manner as to cover the groove, the moving part including a coupling window for an electromagnetic wave of the high frequency signal, the coupling window being positioned above the groove, and a reflecting member that is formed on a lower surface of the moving part in such a manner as to fit in a cross section of the groove and is positioned away from the coupling window by ⅛ to 1/1 of guide wavelength of the high frequency signal, and whose thickness in a longitudinal direction of the groove is not smaller than 1/10 of the guide wavelength, wherein the coupling window and the reflecting member are together movable along the groove in the longitudinal direction, and the electromagnetic wave of the high frequency signal propagated through the waveguide formed by the groove and the lower surface of the moving part is radiated through the coupling window.

In the invention it is preferable that a directional antenna element is mounted above the coupling window of the moving part.

In the invention it is preferable that the upper surface of the base part is made of an electrically conductive material, and a ring groove having a width of ⅛ to ½ of the signal wavelength and a depth of ⅛ to 1/1 of the signal wavelength is formed in the upper surface so as to encircle the groove and be spaced apart from an opening of the groove by ¼ to 1/1 of the signal wavelength.

In the invention it is preferable that a plurality of the ring grooves are formed at pitches of ¼ to 1/1 of the signal wavelength, the innermost ring groove being spaced apart from the opening of the groove by ¼ to 1/1 of the signal wavelength.

In the invention it is preferable that a traverse groove having a width of ⅛ to ½ of the guide wavelength and a depth of 1/100 to ½ of the guide wavelength, and extending in a direction intersecting the longitudinal direction of the groove, is formed in a lower surface of the reflecting member.

In the invention it is preferable that a plurality of the traverse grooves are formed at pitches of ⅛ to 3/2 of the guide wavelength.

In the invention it is preferable that the reflecting member is formed at a position spaced about ¼ or about ¾ of the guide wavelength of the high frequency signal away from the coupling window in the lower surface of the moving part.

In the invention it is preferable that the directional antenna has a short circuited end and an open end, and is mounted so that the coupling window is located at a position spaced about ⅛ to 1/1 of the guide wavelength away from the short circuited end.

In the invention it is preferable that the directional antenna is mounted so that the coupling window is located at a position spaced about ¼ or about ¾ of the guide wavelength away from the short circuited end.

The invention provides a phase shifter comprising: two metal plates arranged in parallel to each other; the primary radiator of the above-described configuration placed between the metal plates; and a wave collector placed between the metal plates, and wherein: the phase of the electromagnetic wave of the high frequency signal emitted through the coupling window and converted by the wave collector is varied by varying the position of the coupling window of the primary radiator relative to the wave collector.

The invention provides a beam scanning antenna comprising: a plurality of slots, formed in one of the metal plates of the phase shifter of the above-described configuration, for coupling the electromagnetic wave to and from the wave collector, wherein a beam direction of the electromagnetic wave to be radiated from the slots is made variable.

In the invention it is preferable that a directional antenna element is mounted above the slots and the phase-controlled high frequency signal is fed to the antenna element.

First, the high frequency signal waveguide, a component of the primary radiator, is constructed using a base part, such as a cabinet, that has a groove whose inner wall is a conductor, and preferably has a conductive surface encircling the groove and conducting to the inner wall conductor of the groove, and a moving part, such as a flat plate, at least whose portion that completely covers the groove is a conductor. The groove has a width of ½ to 1/1 of the signal wavelength $\lambda o$ of the high frequency signal in free space, and a depth of about ¼ of the signal wavelength $\lambda o$.

The moving part is provided with a coupling window for coupling the electromagnetic wave of the high frequency signal between the waveguide and the outside of the flat plate of the moving part by passing through the flat plate. The moving part is also provided with a reflecting member, such as a reflecting plate, that fits in the groove in such a manner as to close the cross section of the groove forming the waveguide, and that reflects the high frequency signal that has not been radiated outside through the coupling window but propagated through the waveguide. The size of the reflecting member is slightly smaller than the cross sectional size of the groove, to allow the reflecting member to move along the groove with the movement of the moving part; the thickness of the reflecting member is not smaller than 1/10 of the guide wavelength $\lambda g$ of the high frequency signal, and the distance between the coupling window and the reflecting member is chosen to be equal to an appropriate one of the values falling within the range of ⅛ to 1/1 of the guide wavelength $\lambda g$ of the high frequency signal in the waveguide.

The primary radiator can thus radiate the electromagnetic wave of the high frequency signal through the coupling window while moving the coupling window and reflecting member along the waveguide.

Preferably, a waveguide antenna, for example, is mounted above the portion corresponding to the outside of the coupling window, and is made movable together with the moving part. By coupling the waveguide to the waveguide antenna via the coupling window of the moving part, the primary radiator can radiate the high frequency signal while moving the waveguide antenna.

Since the high frequency signal leaks through the gap between the base part and the moving part by the parallel-plate mode with zero cutoff frequency, a ring groove having a width of ⅛ to ½ of the signal wavelength λo of the high frequency signal and a depth of ⅛ to 1/1 of the signal wavelength λo is formed in the upper surface of the base part in such a manner to encircle the waveguide groove in the gap between the base part and the moving part, the ring groove being spaced ¼ to 1/1 of the signal wavelength λo away from the opening of the groove and made to act as a choke. This structure can effectively prevent the leakage of the high frequency signal through the gap between the base part and the moving part while allowing the moving part to move along the upper surface of the base part.

Furthermore, since the high frequency signal leaks through the gap between the base part and the moving part by the parallel-plate mode with zero cutoff frequency, it is effective to provide one or more ring grooves as a choke in such a manner as to encircle the waveguide groove by multiple ring grooves; as the number of ring grooves is increased, the function of the choke for preventing the leakage of the high frequency signal is enhanced. In this case, the multiple ring grooves should be formed at pitches of ¼ to 1/1 of the signal wavelength λo.

Preferably, for the reflecting member also, a groove having a width of ⅛ to ½ of the guide wavelength λg and a depth of 1/100 to ½ the guide wavelength λg, and traversing the reflecting member in a direction intersecting the longitudinal direction of the waveguide groove, is formed in the lower surface of the reflecting member that faces the bottom surface of the waveguide groove. It is also preferable to form a plurality of such traverse grooves at pitches of ⅛ to 3/2 of the guide wavelength λg. When such traverse grooves are formed, and the sum of the depth of the traverse groove and the distance from the traverse groove to the end face of the reflecting member is set equal to ⅛ to 3/2 of the guide wavelength λg, the end face of the reflecting member can provide an electrical short circuiting condition with respect to the waveguide, though the end face of the reflecting member is not physically short circuited to the waveguide, and this serves to effectively prevent the high frequency signal from leaking through the reflecting member.

Then, by placing the primary radiator and flat plate-like wave collector of the above configuration between the parallel plates consisting of two metal plates arranged in parallel to each other, the phase shifter can be constructed that can vary the phase of the high frequency electromagnetic wave signal that has been radiated as a spherical wave from the coupling window of the primary radiator and converted into a plane wave by the wave collector.

Further, when a plurality of slots for coupling electromagnetic waves to and from the wave collector is formed in one of the parallel plates in the structure comprising the primary radiator and wave collector of the above configuration placed between the parallel plates, then by feeding power to the slots the high frequency electromagnetic wave signal can be radiated directly from the slots while varying the radiating direction of the electromagnetic wave beam, and the structure can thus be made to function as a beam scanning antenna. Furthermore, another directional antenna element may be mounted above the slots on the outside of the parallel plate; in this case, by feeding the phase controlled high frequency signal to this antenna element, the antenna element can be made to function as a beam scanning antenna.

As described in detail above, according to the primary radiator of the invention, the high frequency signal waveguide is constructed using the base part, in which is formed the groove whose inner wall is formed of a conductor, and the moving part, which is placed over the upper surface of the base part in such a manner as to cover the groove, and which includes the coupling window formed above the groove and the reflecting member formed in a prescribed position in such a manner as to close the cross section of the groove, and the high frequency electromagnetic wave signal propagated through the waveguide formed by the groove and the lower surface of the moving part is radiated from the coupling window while the coupling window and reflecting member are being moved along the groove in the longitudinal direction thereof; therefore, the primary radiator can be made structurally independent of the transmitter/receiver connected to it, allowing only the primary radiator to be moved without moving the transmitter/receiver, and an inexpensive, high-reliability, and high-performance phase shifter and beam scanning antenna can be constructed using the primary radiator of the above structure.

Furthermore, by forming a prescribed ring groove encircling the opening of the groove in the upper surface of the base part, or by forming a prescribed traverse groove in the lower surface of the reflecting member, a high efficiency primary radiator substantially free from high frequency signal leakage can be achieved.

Further, according to the phase shifter of the invention, the primary radiator and flat plate-like of the invention are placed between the two metal plates arranged in parallel to each other, and the phase of the high frequency electromagnetic wave signal, radiated from the coupling window and converted by the wave collector, is varied by varying the position of the coupling window of the primary radiator relative to the wave collector; in this way, the phase shifter of the invention can continuously control the phase by moving the primary radiator. More specifically, by varying the positional relationship between the primary radiator and the wave collector, the tilting of the phase of the signal fed to the slots can be varied, and as a result, a phase shifter operating in the microwave or millimeter wave band and having good characteristics can be achieved using simple configuration.

Furthermore, according to the beam scanning antenna of the invention, a plurality of slots for coupling electromagnetic waves to and from the wave collector is formed in one of the metal plates of the phase shifter of the invention, and the direction of the electromagnetic wave beam radiated from the slots is made variable; accordingly, the beam scanning antenna of the invention, while moving the primary radiator, can scan the beam by radiating the high frequency signal directly from the slots after controlling the phase by the wave collector, or by feeding the high frequency signal to another antenna through the slots.

BRIEF DESCRIPTION OF THE DRAWINGS

Other and further objects, features, and advantages of the invention will be more explicit from the following detailed description taken with reference to the drawings wherein:

FIG. 1 is an exploded perspective view for explaining the construction of a primary radiator according to one embodiment of the present invention;

FIG. 2 is a perspective view showing one example of the primary radiator of the invention of FIG. 1 in an assembled condition;

DETAILED DESCRIPTION OF THE PREFERRED EMBODIMENTS

Figure 3A:
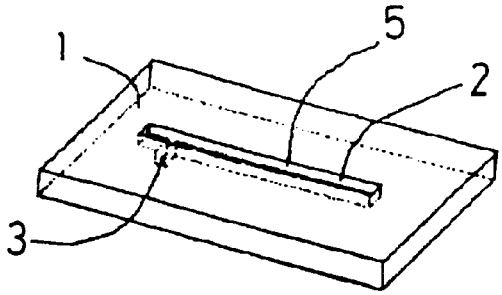
FIG. 3A is a perspective view showing the base part of the primary radiator according to the embodiment of the invention shown in FIG. 1.

Now referring to the drawings, preferred embodiments of the invention are described below.

The primary radiator, phase shifter, and beam scanning antenna of the present invention will be described below with reference to the accompanying drawings.

FIG. 1 is an exploded perspective view for explaining the construction of a primary radiator according to one embodiment of the present invention. FIG. 2 is a perspective view showing one example of the primary radiator of the invention of FIG. 1 in an assembled condition.

In FIGS. 1 and 2, the primary radiator of the present invention comprises a base part 1 and a moving part 4. The base part 1 is formed, for example, of a metal, and includes a groove 2 which acts as a waveguide for guiding a high frequency signal therethrough; the groove 2 has a width of ½ to 1/1 of the signal wavelength λ of the high frequency signal in free space and a depth of ¼ of the signal wavelength λo. In the illustrated example, an input window 3 is formed in the bottom of the groove 2 at a position spaced away from one end of the groove 2 by a distance of ⅛ to 1/1, preferably about ¼ or ¾, of the signal wavelength λo of the high frequency signal, and the high frequency signal is input from the underside of the base part 1 through a waveguide not shown. The moving part 4 is formed from a flat metal plate or the like, and is placed over the upper surface of the base part 1 in such a manner as to completely cover the groove 2. The groove 2 and the moving part 4 placed over the upper surface of the base part 1 together form the waveguide 5 for the high frequency signal.

The moving part 4 is provided with a coupling window 6 which is formed through the moving part 4 at a position above an edge portion of the groove 2 where the magnetic field amplitude is the greatest when a high frequency electromagnetic wave signal of TE10 mode, the fundamental mode of the waveguide, propagates through the waveguide 5. On the lower surface of the moving part 4 is formed a reflecting member 7 which is slightly smaller in dimension than the groove 2 and is shaped to close the cross section of the groove 2; the reflecting member 7 is provided as a signal reflector at a position spaced away from the coupling window 6 in the direction opposite the input window 3 by a distance of ⅛ to 1/1, preferably about ¼ or ¾, of the guide wavelength λo of the high frequency signal in the waveguide 5.

If it were not for the reflecting member 7, of the high frequency signal input through the input window 3, the component propagated along the waveguide 5 and input directly to the coupling window 6 and the component not directly input to the coupling window 6 but input to it after being propagated through and reflected at a short circuited end face of the waveguide 5 would constitute the components input to the coupling window 6. If the distance from the coupling window 6 to the end face at which the signal propagated through the waveguide 5 is reflected is adjusted so that the phase of the directly input component matches the phase of the component that is input after being reflected, the coupling efficiency becomes the highest. Therefore, in order that the distance between the coupling window 6 and the short circuited end face of the waveguide 5 is maintained constant even when the moving part 4, the coupling window 6, and the waveguide horn antenna 8 described later are moved, the reflecting member 7 is attached to the lower side of the moving part 4 at a position spaced away from the coupling window 6 in the direction opposite the input window 3 by a distance of about ¼ or ¾ of the guide wavelength λg of the high frequency signal.

If the distance from the coupling window 6 to the reflecting member 7 is set equal to an appropriate one of the values falling within the range of ⅛ to 1/1 of the guide wavelength λg of the high frequency signal, the coupling efficiency at the coupling window 6 can be maximized.

A directional antenna element such as a dipole antenna—in this embodiment, the waveguide horn antenna 8—is mounted above the coupling window 6 of the moving part 4. The waveguide horn antenna 8 is coupled to the waveguide 5 via the coupling window 6. Here, the waveguide horn antenna 8 is mounted relative to the coupling window 6 so that its short circuited end is located at a position spaced away from the coupling window 6 by a distance of about ⅛ to 1/1, preferably about ¼ or ¾, of the guide wavelength λg, and high frequency electromagnetic waves are radiated over a prescribed beam angle from its open end formed in the shape of a horn.

With the above configuration, the high frequency signal input through the input window 3 is propagated through the waveguide 5 formed by the groove 2 of the base part 1 and the flat plate-like moving part 4, and fed via the coupling window 6 to the waveguide horn antenna 8 where the direction of the electromagnetic wave beam is changed by about 90 degrees, thereby radiating the beam into free space from the waveguide horn antenna 8. The waveguide horn antenna 8 is mounted on the moving part 4 which is freely movable in directions parallel to the upper surface of the base part 1 as indicated by arrows in the figure, the waveguide horn antenna 8 being oriented in a direction at right angles to the longitudinal direction of the waveguide 5 and parallel to the plane in which the moving part 4 moves in parallel directions; therefore, the waveguide horn antenna 8, while moving together with the moving part 4 in parallel directions, radiates the high frequency signal by changing the direction of the beam to the direction in which the waveguide horn antenna 8 is oriented.

A phase shifter can be constructed by arranging the above-described primary radiator of the invention between two parallel flat metal plates together a flat plate-like wave collector for collecting the electromagnetic waves radiated from the primary radiator. The phase of the high frequency electromagnetic wave signal, radiated as a spherical wave from the primary radiator and converted into a plane wave by the wave collector, can be varied by varying the position of the coupling window 6 of the primary radiator or, if the waveguide horn antenna 8 is provided, then by varying the position of the waveguide horn antenna 8 relative to the wave collector.

Further, in the phase shifter constructed by sandwiching the primary radiator and wave collector of the invention between the two parallel metal plates, if a plurality of slots for coupling electromagnetic waves to and from the wave collector are formed in one of the metal plates, with provisions made to feed the high frequency signal from the primary radiator to the slots, a beam scanning antenna can be constructed. With this structure, the direction of the electromagnetic wave beam radiated from the slots can be varied. Furthermore, if other directional antenna elements are mounted above the slots, and phase controlled high frequency signals is fed to these antenna elements, these other antenna elements can be made to function as a beam scanning antenna.

Figure 3B:
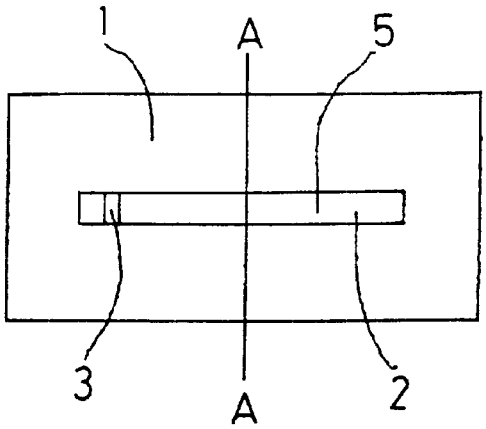
FIG. 3B is a top plan view of the same.
Figure 3C:
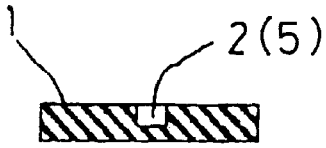
FIG. 3C is a cross sectional view taken along line A—A in FIG. 3B.

FIG. 3A is a perspective view showing the base part 1 of the primary radiator according to the embodiment of the invention shown in FIG. 1, FIG. 3B is a top plan view of the same, and FIG. 3C is a cross sectional view taken along line A—A in FIG. 3B. In FIGS. 3A to 3C, the base part 1 is formed of a metal or the like and includes the groove 2 as the high frequency signal waveguide 5. The input window 3 is formed in the bottom of the groove 2 of the base part 1, and the high frequency signal is input from the underside of the base part 1 through an external waveguide (not shown).

Figure 4A:
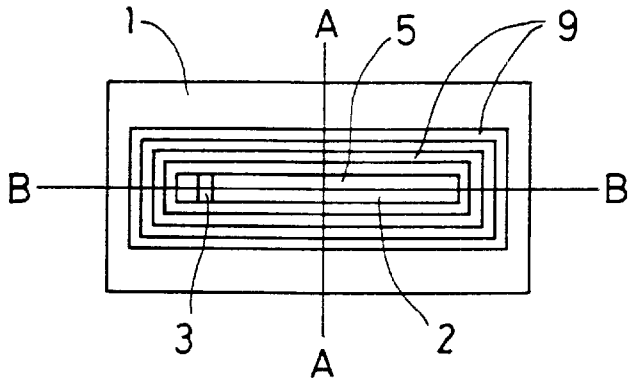
FIG. 4A is a top plan view of the base part.
Figure 4B:
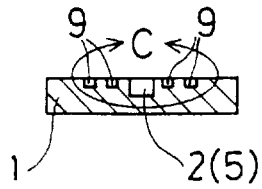
FIG. 4B is a cross sectional view taken along line A—A in FIG. 4A.
Figure 4C:
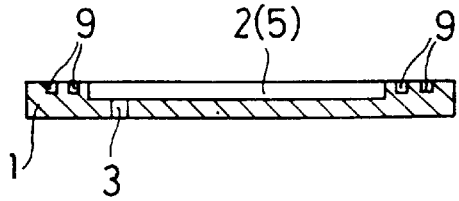
FIG. 4C is a cross sectional view taken along line B—B in FIG. 4A.
Figure 4D:
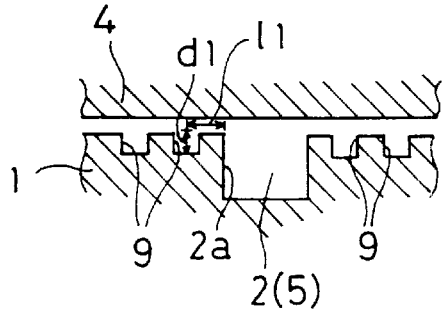
FIG. 4D is an enlarged cross sectional view showing section C of FIG. 4B together with a moving part 4.

FIGS. 4A to 4D show the base part 1 in another embodiment of the primary radiator according to the present invention. FIG. 4A is a top plan view of the base part 1, FIG. 4B is a cross sectional view taken along line A—A in FIG. 4A, FIG. 4C is a cross sectional view taken along line B—B in FIG. 4A, and FIG. 4D is an enlarged cross sectional view showing section C of FIG. 4B together with the moving part 4.

In FIGS. 4A to 4D also, the primary radiator includes the base part 1, the groove 2, the input window 3, and the high frequency signal waveguide 5. In the illustrated example, the upper surface of the base part 1 is formed of an electrical conductive material, for example, a metal, and two ring grooves 9 are formed in the upper surface in such a manner as to doubly encircle the opening of the groove 2. The ring grooves 9 are covered by the lower surface of the moving part 4 and acts as a choke for the high frequency signal. The ring grooves 9 are each formed with a width of ⅛ to ½ of the signal wavelength λo of the high frequency signal in free space, and a depth of ⅛ to 1/1 of the signal wavelength λo; at least one ring groove should be formed at a distance of ¼ to 1/1 of the signal wavelength λo from the opening of the groove 2. When providing more than one ring groove 9, the ring grooves 9 should be formed at pitches of ¼ to 1/1 of the signal wavelength λo in such a manner as to encircle the groove 2 with multiple rings.

When such ring grooves 9 are formed in such a manner as to encircle the opening of the groove 2 acting as the waveguide 5 for the high frequency signal, the ring grooves 9 function as a choke to prevent the high frequency signal from leaking from the opening of the groove 2 through the gap between the upper surface of the base part 1 and the lower surface of the moving part 4, and a high efficiency primary radiator can thus be constructed using the waveguide 5 in which the loss due to leakage of the high frequency signal is reduced.

More specifically, the bottom of each ring groove 9 provided as a choke as described above provides an electrical short circuiting condition; as a result, when the sum of the depth of the ring groove 9 and the distance from the ring groove 9 to the opening of the groove 2 as the waveguide 5, more specifically, the sum of the depth d1 of the ring groove 9 and the distance 11 from the widthwise center of the ring groove 9 to its adjacent side wall 2*a* that defines the groove 2 as the waveguide 5 as shown in FIG. 4D, is an integral multiple of ½ of the signal wavelength λo, an electrical short circuiting condition can be provided even if the groove 2 forming the waveguide 5 is not physically short circuited to the moving part 4. This allows the moving part 4 to move along the upper surface of the base part 1, while at the same time, preventing the high frequency signal from leaking through the gap between the moving part 4 and the base part 1.

To evaluate how much the leakage of the high frequency signal can be reduced by such ring grooves 9, leakage of the high frequency signal from the waveguide 5 was measured using a finite element method by varying the width and depth of the ring groove 9. The results are shown in FIGS. 7A to 7B.

Figure 7A:
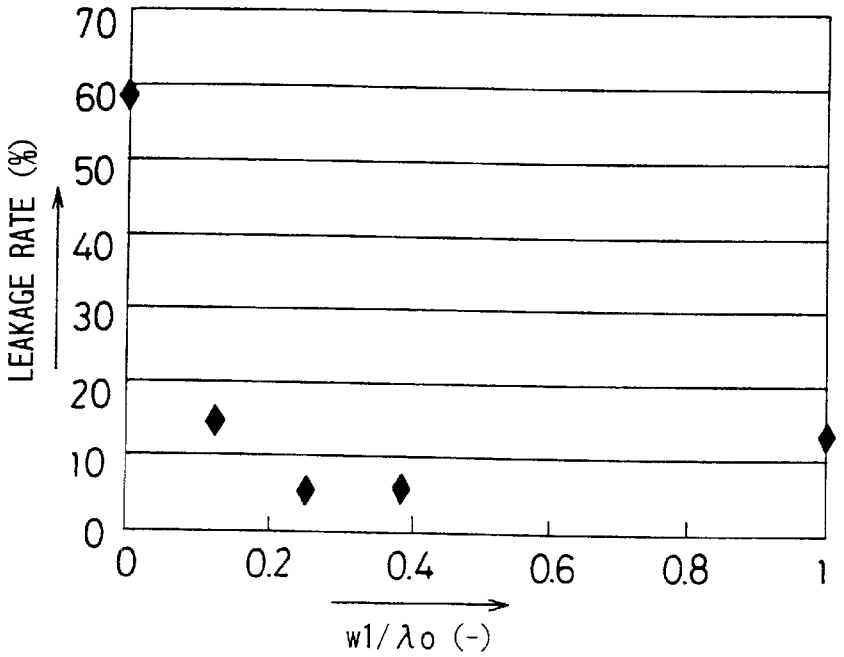
FIGS. 7A and 7B are diagrams showing the effectiveness of the ring groove formed in the base part of the primary radiator of the invention.

FIG. 7A shows the change of the leakage rate when the width w1 of the ring groove 9 was varied; the horizontal axis represents the ratio of the width w1 of the ring groove 9 to the signal wavelength λo of the high frequency signal (unit: none), and the vertical axis the leakage rate (unit: %) of the high frequency signal, while black rhombic marks in the figure show the calculated results. As can be seen, the leakage of the high frequency signal is minimum when the width w1 of the ring groove 9 is made approximately equal to ¼ of the signal wavelength λo of the high frequency signal. In the example shown here, two ring grooves 9 were formed at pitches of ¼ of the signal wavelength λo.

Figure 7B:
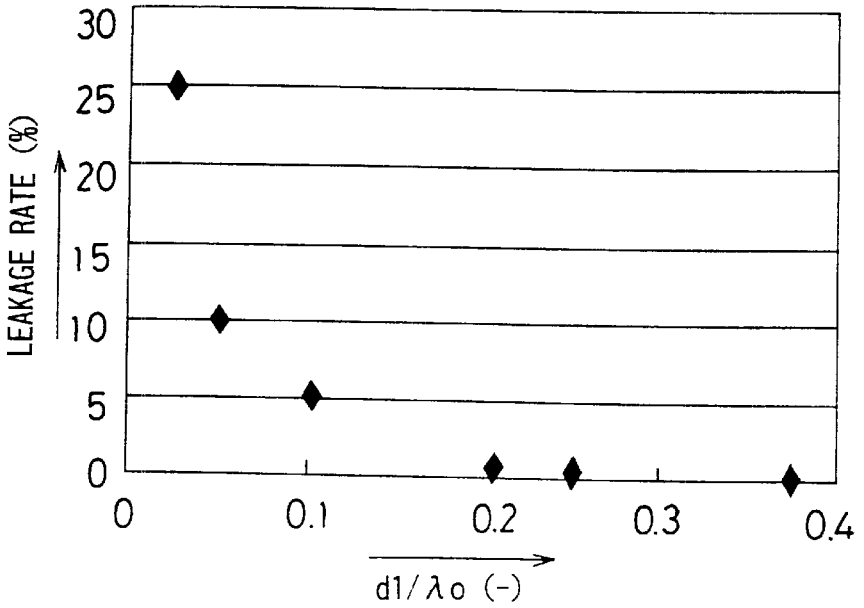

FIG. 7B shows the change of the leakage rate when the depth d1 of the ring groove 9 was varied; the horizontal axis represents the ratio of the depth d1 of the ring groove 9 to the signal wavelength λo of the high frequency signal (unit: none), and the vertical axis the leakage rate (unit: %) of the high frequency signal, while black rhombic marks in the figure show the calculated results. As can be seen, the leakage rate can be reduced to 5% or less when the depth d1 of the ring groove 9 is equal to or larger than ⅛ of the signal wavelength λo, and the leakage of the high frequency signal can be reduced to a negligible level when the depth d1 is equal to or larger than 1/5 of the wavelength. In the example shown here, two ring grooves 9 were formed, the width w1 of each groove and the spacing between the grooves being set equal to 1/4 of the signal wavelength λo.

Figure 5A:
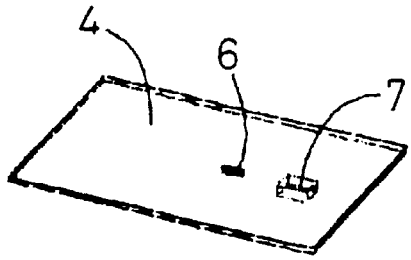
FIG. 5A is a perspective view showing the moving part 4 of the primary radiator according to the embodiment of the invention shown in FIG. 1.
Figure 5B:
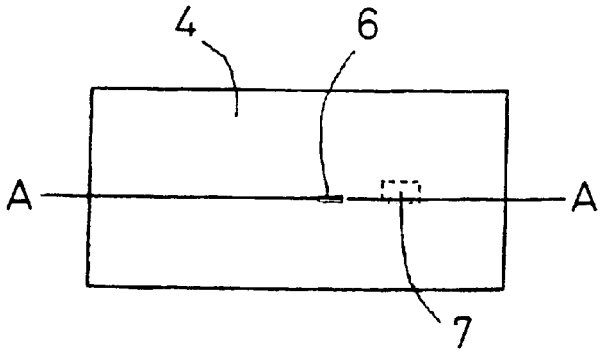
FIG. 5B is a top plan view of the same.
Figure 5C:
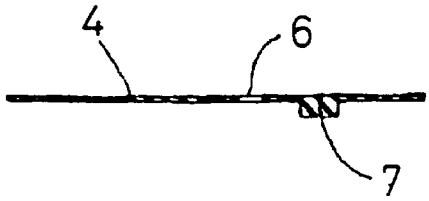
FIG. 5C is a cross sectional view taken along line A—A in FIG. 5B.

FIG. 5A is a perspective view showing the moving part 4 of the primary radiator according to the embodiment of the invention shown in FIG. 1, FIG. 5B is a top plan view of the same, and FIG. 5C is a cross sectional view taken along line A—A in FIG. 5B. In FIGS. 5A to 5C, the moving part 4 is formed from an electrically conductive flat plate. The coupling window 6 for high frequency electromagnetic waves is formed at a position above the groove 2 formed in the upper surface of the base part 1. The reflecting member 7 as a signal reflector is formed at a position spaced away from the coupling window 6 on the lower surface of the moving part 4 in the direction opposite the input window 3 of the groove 2 by a distance of 1/8 to 1/1, preferably about 1/4 or 3/4, of the guide wavelength λg of the high frequency signal. The reflecting member 7 fits in the groove 2 to close the cross section of the groove 2, and its thickness measured in the longitudinal direction of the groove 2 is equal to or larger than 1/1 of the guide wavelength λg of the high frequency signal.

Figure 6A:
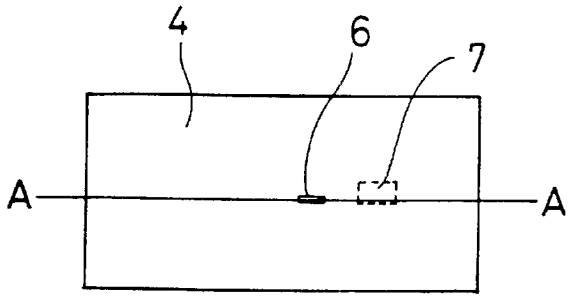
FIG. 6A is a top plan view of the moving part.
Figure 6B:
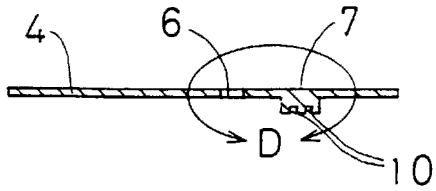
FIG. 6B is a cross sectional view taken along line A—A in FIG. 6A.
Figure 6C:
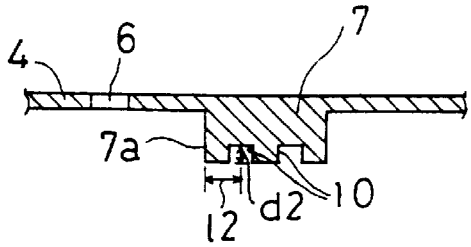
FIG. 6C is an enlarged cross sectional view showing section D of FIG. 6B.

FIGS. 6A to 6C show the moving part 4 in another embodiment of the primary radiator according to the present invention. FIG. 6A is a top plan view of the moving part 4, FIG. 6B is a cross sectional view taken along line A—A in FIG. 6A, and FIG. 6C is an enlarged cross sectional view showing section D of FIG. 6B.

In FIGS. 6A and 6B also, the primary radiator includes the moving part 4, the coupling window 6 and the reflecting member 7. In the illustrated example, two traverse grooves 10, each traversing the lower surface of the reflecting member 7 in a direction at right angles to the longitudinal direction of the groove 2 and having a depth of 1/8 to 1/2 of the guide wavelength λg of the high frequency signal and a depth of 1/100 to 1/2 of the guide wavelength λg, are formed in the lower surface of the reflecting member 7, that is, on the side that faces the bottom surface of the groove 2 forming the waveguide 5 of the base part 1. Since, in the waveguide 5, the direction of the electric field of the high frequency signal is perpendicular to the bottom of the groove 2, the traverse grooves 10 act as a choke to prevent the high frequency signal from leaking through the gap between the bottom of the groove 2 and the lower surface of the reflecting member 7. With the formation of such traverse grooves 10, the loss due to leakage of the high frequency signal from the end face of the waveguide 5 when the reflecting member 7 is provided can be reduced, achieving the construction of a high efficiency primary radiator.

More specifically, one or more traverse grooves 10 acting as a choke, each having a depth of 1/100 to 1/2 of the guide wavelength λg, are formed in the reflecting member 7 with a pitch of 1/8 to 1/1 of the guide wavelength λg, and the sum of the depth of the traverse groove 10 and the distance from the traverse groove 10 to the end face of the reflecting member 7, more specifically, the sum of the depth d2 of the traverse groove 10 and the distance 12 from the widthwise center of the traverse groove 10 to its adjacent end face 7*a* of the reflecting member 7 as shown in FIG. 6C, is set equal to 1/8 to 3/2 of the guide wavelength λg. As a result, though the end face of the reflecting member 7 is not physically short circuited to the groove 2 that forms the waveguide 5, the end face can provide an electrical short circuiting condition. This serves to effectively prevent the high frequency signal from leaking past the reflecting member 7.

Here, since, in the waveguide 5, the direction of the electric field of the high frequency signal is parallel to the side face of the reflecting member, that is, the side that faces the side face of the groove 2, there is no particular need to provide a high frequency signal impeding choke structure on the side face, because the high frequency signal leaks little through the gap between the side face of the groove 2 and the side face of the reflecting member 7.

The most effective result can be obtained when the traverse groove 10 is formed extending at right angles to the longitudinal direction of the groove 2, but even when the traverse groove 10 is formed in an oblique direction, the loss can be reduced by preventing the leakage of the high frequency signal, as long as the traverse groove 10 is formed in such a manner as to traverse the lower surface of the reflecting member 7 in a direction intersecting the longitudinal direction of the groove 2.

Only one traverse groove 10 need be formed in the lower surface of the reflecting member 7, but if more than one is formed, the leakage of the high frequency signal can be prevented more reliably. When forming more than one traverse groove 10, it is preferable to form the traverse grooves 10 at pitches of 1/8 to 3/2 of the guide wavelength λg, because a choke that can effectively impede the high frequency signal can then be formed.

To evaluate how much the leakage of the high frequency signal can be reduced by such traverse grooves 10, leakage of the high frequency signal from the waveguide 5, i.e., the percentage of the high frequency signal not reflected by the reflecting member 7 but leaked through the gap between the groove 2 and the reflecting member 7, was measured using a finite element method by varying the width and depth of the traverse groove 10. The results are shown in FIGS. 8A to 8B.

Figure 8A:
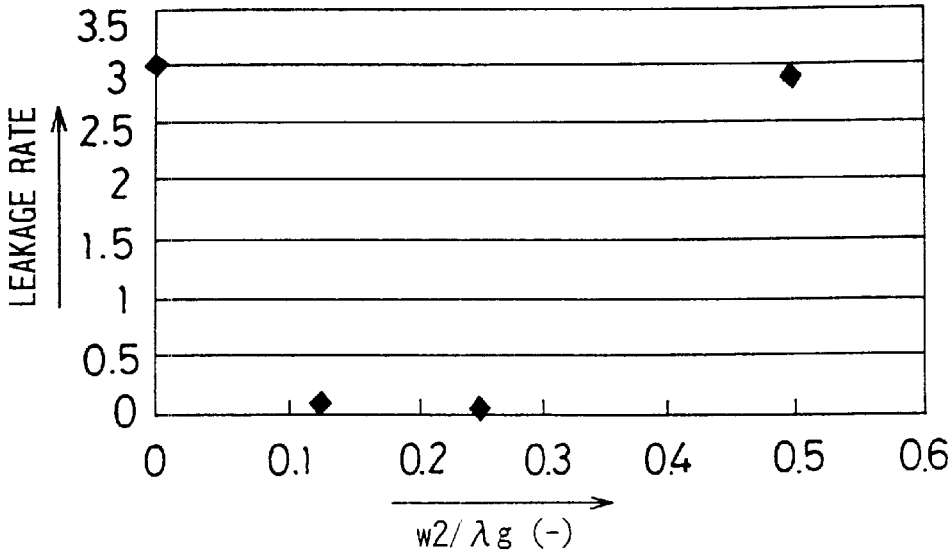
FIGS. 8A and 8B are diagrams showing the effectiveness of the traverse groove formed in the moving part of the primary radiator of the invention.

FIG. 8A shows the change of the leakage rate when the width w of the traverse groove 10 was varied; the horizontal axis represents the ratio of the width w of the traverse groove 10 to the guide wavelength λg of the high frequency signal (unit: none), and the vertical axis the leakage rate (unit: %) of the high frequency signal, while black rhombic marks in the figure show the calculated results. As can be seen, the leakage of the high frequency signal is minimum when the width w of the traverse groove 10 is made approximately equal to 1/4 of the guide wavelength λg of the high frequency signal in the waveguide 5. In the example shown here, two traverse grooves 10 were formed at pitches of 1/4 of the guide wavelength λg.

Figure 8B:
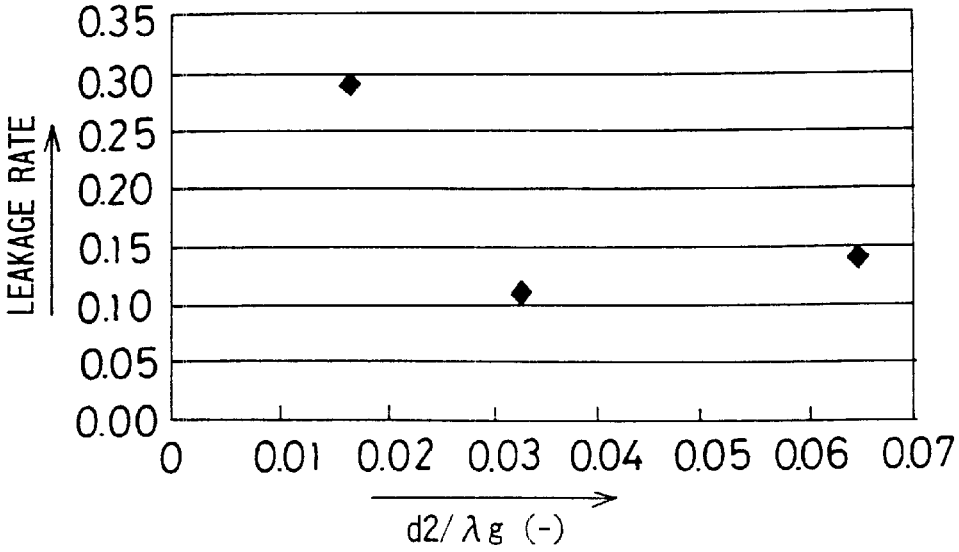

FIG. 8B shows the change of the leakage rate when the depth d of the traverse groove 10 was varied; the horizontal axis represents the ratio of the depth d of the traverse groove 10 to the guide wavelength λg of the high frequency signal (unit: none), and the vertical axis the leakage rate (unit: %) of the high frequency signal, while black rhombic marks in the figure show the calculated results. As can be seen, the leakage rate can be reduced to 35% or less when the depth d of the traverse groove 10 is equal to or larger than 1/100 of the guide wavelength λg, and the leakage of the high frequency signal can be reduced to a negligible level of 0.30% or less when the depth d is equal to or larger than 15/100 of the wavelength. In the example shown here, two traverse grooves 10 were formed, the width w of each groove and the spacing between the grooves being set equal to 1/4 of the guide wavelength λg.

Figure 9A:
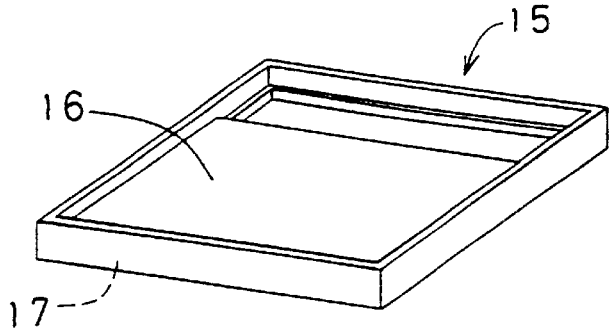
FIG. 9A is a perspective view showing in simplified form the construction of a phase shifter 15 according to one embodiment of the present invention.
Figure 9B:
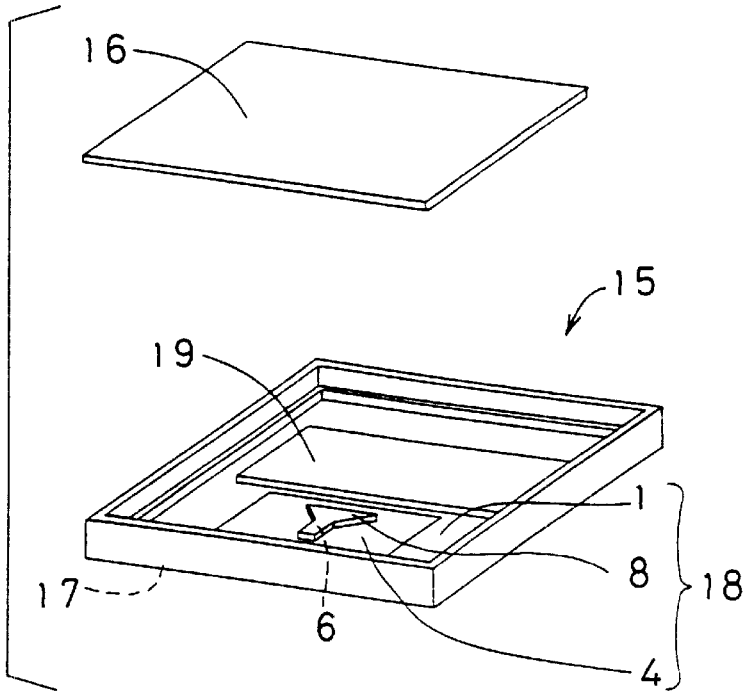
FIG. 9B is an exploded perspective view showing in simplified form the construction of the phase shifter 15 according to the embodiment of the invention.

Using the primary radiator of the invention that is provided with the ring grooves 9 and traverse grooves 10 described above, a high efficiency phase shifter, such as shown in FIGS. 9A and 9B, and a beam scanning antenna, such as shown in FIGS. 10A, 10B, 11A, and 11B, can be achieved according to the present invention by reducing the loss due to the leakage of the high frequency signal.

FIG. 9A is a perspective view showing in simplified form the construction of a phase shifter 15 according to one embodiment of the present invention, and FIG. 9B is an exploded perspective view showing in simplified form the construction of the phase shifter 15 according to the embodiment of the invention. In this embodiment, parts corresponding to those shown in the above embodiments will be designated by the same reference numerals, and a description of such parts will not be repeated here.

The phase shifter 15 of the invention comprises two metal plates 16 and 17 arranged parallel to each other, a primary radiator 18 placed between the metal plates 16 and 17, and a flat plate-like wave collector 19 placed between the metal plates 16 and 17. The primary radiator 18 comprises the base part 1, the moving part 4, and the waveguide horn antenna 8, as in the above-described embodiments. The wave collector 19 converts the spherical wave radiated from the coupling window 6 of the primary radiator 18, into a plane wave. By varying the position of the coupling window 6 of the primary radiator 18 relative to the wave collector 19, the phase shifter 15 can vary the phase of the high frequency electromagnetic wave signal radiated from the coupling window 6 and converted by the wave collector 19.

Figure 10A:
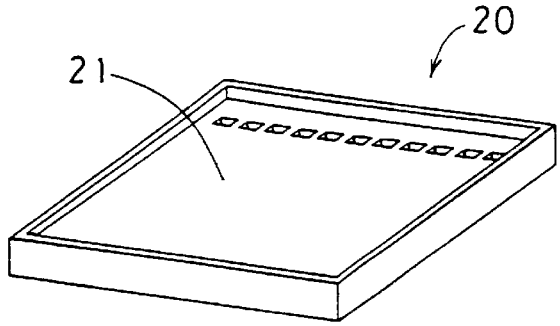
FIG. 10A is a perspective view showing in simplified form the construction of a beam scanning antenna 20 according to one embodiment of the present invention.
Figure 10B:
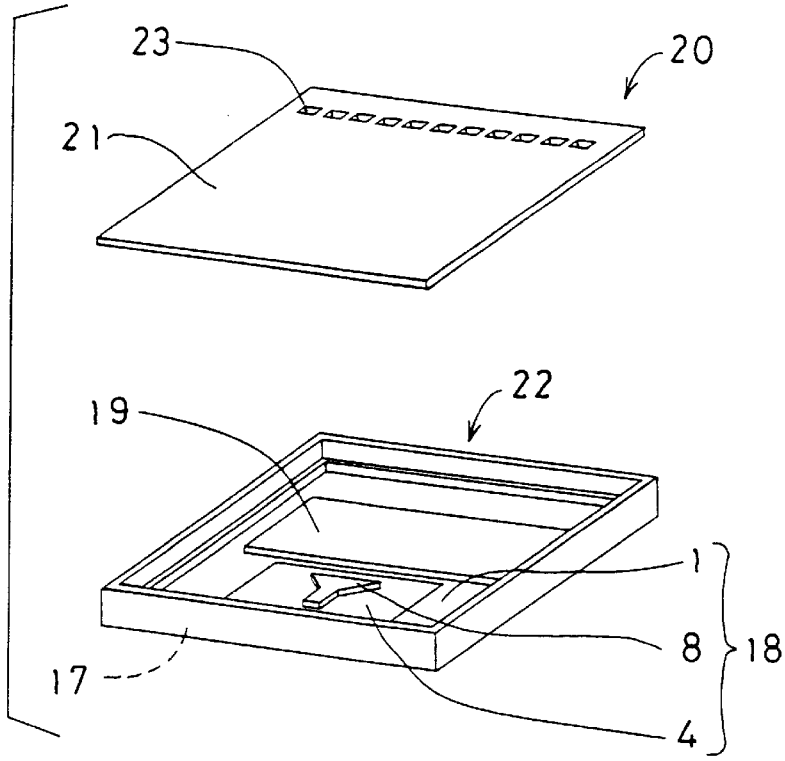
FIG. 10B is an exploded perspective view showing in simplified form the construction of the beam scanning antenna 20 according to the embodiment of the invention.

FIG. 10A is a perspective view showing in simplified form the construction of a beam scanning antenna 20 according to one embodiment of the present invention, and FIG. 10B is an exploded perspective view showing in simplified form the construction of the beam scanning antenna 20 according to the embodiment of the invention. In this embodiment, parts corresponding to those shown in the above embodiments will be designated by the same reference numerals, and a description of such parts will not be repeated here.

The beam scanning antenna 20 of the invention comprises two metal plates 21 and 17 arranged parallel to each other, the primary radiator 18 placed between the metal plates 21 and 17, and the flat plate-like wave collector 19 placed between the metal plates 21 and 17; the beam scanning antenna 20 further includes a phase shifter 22 which varies the phase of the high frequency signal, radiated from the coupling window 6 and converted by the wave collector 19, by varying the position of the coupling window 6 of the primary radiator 18 relative to the wave collector 19, and a plurality of slots 23 for coupling electromagnetic waves to and from the wave collector 19 are formed in one of the metal plates 21 and 17, i.e., in the metal plate 21, of the phase shifter 22. The primary radiator 18 comprises the base part 1, the moving part 4, and the waveguide horn antenna 8, as in the above-described embodiments. The wave collector 19 converts the spherical wave radiated from the coupling window 6 of the primary radiator 18, into a plane wave. By varying the position of the coupling window 6 of the primary radiator 18 relative to the wave collector 19, the phase shifter 22 changes the phase of the high frequency signal radiated from the coupling window 6 and converted by the wave collector 19. By feeding power to these slots 23, the beam scanning antenna 20 can radiate high frequency electromagnetic waves directly from the slots 23 while varying the direction of the electromagnetic wave beam.

Figure 11A:
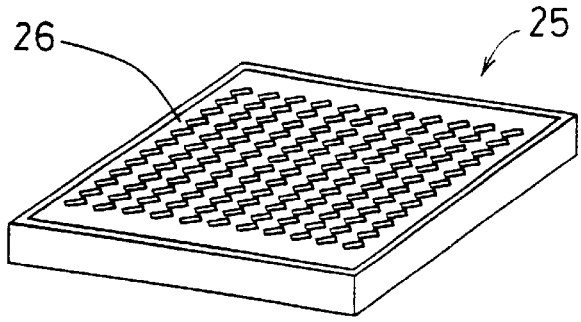
FIG. 11A is a perspective view showing in simplified form the construction of a beam scanning antenna 25 according to another embodiment of the present invention.
Figure 11B:
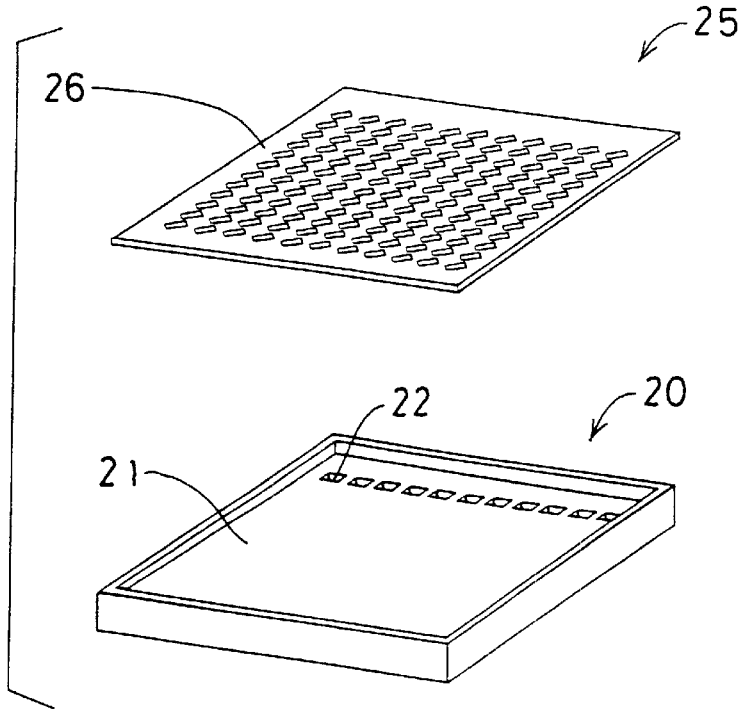
FIG. 11B is an exploded perspective view showing in simplified form the construction of the beam scanning antenna 25 according to that other embodiment of the invention.

FIG. 11A is a perspective view showing in simplified form the construction of a beam scanning antenna 25 according to another embodiment of the present invention, and FIG. 11B is an exploded perspective view showing in simplified form the construction of the beam scanning antenna 25 according to that other embodiment of the invention. In this embodiment, parts corresponding to those shown in the above embodiments will be designated by the same reference numerals, and a description of such parts will not be repeated here.

The beam scanning antenna 25 of the invention is similar in construction to the beam scanning antenna 20 shown in FIGS. 10A and 10B, except one important difference, that is, directional antenna elements 26 are mounted above the slots 23 and the phase-controlled high frequency signal is fed to these antenna elements. With this construction, these other antenna elements can be made to function as a beam scanning antenna.

The present invention is not limited to the several embodiments described above, but various modifications may be made without departing from the spirit and scope of the invention. For example, in any of the above embodiments, the base part 1 provided with the groove 2 forming the waveguide 5, the moving part 4, and other components have been described as being formed of metal, but it will be appreciated that these components may be fabricated by injection-molding resin materials such as plastics and forming conductors on their surfaces by plating or the like, or by forming conductors by metalization, etc. on the surfaces of multi-layered ceramic structures.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A primary radiator comprising:

a base part in an upper surface of which a groove having a width of ½ to 1/1 of signal wavelength of a high frequency signal and a depth approximately equal to ¼ of the signal wavelength, and whose inner wall is formed of an electrically conductive material, is formed as a waveguide for the high frequency signal; and a moving part formed of an electrically conductive material and placed above the upper surface of the base part in such a manner as to cover the groove, the moving part including a coupling window for an electromagnetic wave of the high frequency signal, the coupling window being positioned above the groove, and a reflecting member that is formed on a lower surface of the moving part in such a manner as to fit in a cross section of the groove and is positioned away from the coupling window by ⅛ to 1/1 of guide wavelength of the high frequency signal, and whose thickness in a longitudinal direction of the groove is not smaller than 1/10 of the guide wavelength, wherein the coupling window and the reflecting member are together movable along the groove in the longitudinal direction, and the electromagnetic wave of the high frequency signal propagated through the waveguide formed by the groove and the lower surface of the moving part is radiated through the coupling window.

2. The primary radiator of claim 1, wherein a directional antenna element is mounted above the coupling window of the moving part.

3. The primary radiator of claim 2, wherein the directional antenna has a short circuited end and an open end, and is mounted so that the coupling window is located at a position spaced about 1/8 to 1/1 of the guide wavelength away from the short circuited end.

4. The primary radiator of claim 3, wherein the directional antenna is mounted so that the coupling window is located at a position spaced about 1/4 or about 3/4 of the guide wavelength away from the short circuited end.

5. The primary radiator of claim 1, wherein the upper surface of the base part is made of an electrically conductive material, and a ring groove having a width of 1/8 to 1/2 of the signal wavelength and a depth of 1/8 to 1/1 of the signal wavelength is formed in the upper surface so as to encircle the groove and be spaced apart from an opening of the groove by 1/4 to 1/1 of the signal wavelength.

6. The primary radiator of claim 5, wherein a plurality of the ring grooves are formed at pitches of 1/4 to 1/1 of the signal wavelength, the innermost ring groove being spaced apart from the opening of the groove by 1/4 to 1/1 of the signal wavelength.

7. The primary radiator of claim 1, wherein a traverse groove having a width of 1/8 to 1/2 of the guide wavelength and a depth of 1/100 to 1/2 of the guide wavelength, and extending in a direction intersecting the longitudinal direction of the groove, is formed in a lower surface of the reflecting member.

8. The primary radiator of claim 7, wherein a plurality of the traverse grooves are formed at pitches of 1/8 to 3/2 of the guide wavelength.

9. The primary radiator of claim 1, wherein the reflecting member is formed at a position spaced about 1/4 or about 3/4 of the guide wavelength of the high frequency signal away from the coupling window in the lower surface of the moving part.

10. A phase shifter comprising:

two metal plates arranged in parallel to each other;

a primary radiator placed between the metal plates, including:

a base part in an upper surface of which a groove having a width of 1/2 to 1/1 of signal wavelength of a high frequency signal and a depth approximately equal to 1/4 of the signal wavelength, and whose inner wall is formed of an electrically conductive material, is formed as a waveguide for the high frequency signal; and a moving part formed of an electrically conductive material and placed above the upper surface of the base part in such a manner as to cover the groove, the moving part including a coupling window for an electromagnetic wave of the high frequency signal, the coupling window being positioned above the groove, and a reflecting member that is formed on a lower surface of the moving part in such a manner as to fit in a cross section of the groove and is positioned away from the coupling window by 1/8 to 1/1 of guide wavelength of the high frequency signal, and whose thickness in a longitudinal direction of the groove is not smaller than 1/10 of the guide wavelength, wherein the coupling window and the reflecting member are together movable along the groove in the longitudinal direction, and the electromagnetic wave of the high frequency signal propagated through the waveguide formed by the groove and the lower surface of the moving part is radiated through the coupling window; and a wave collector placed between the metal plates, wherein the phase of the electromagnetic wave of the high frequency signal emitted through the coupling window and converted by the wave collector is varied by varying the position of the coupling window of the primary radiator relative to the wave collector.

11. A beam scanning antenna comprising:

a phase shifter including:

two metal plates arranged in parallel to each other;

a primary radiator placed between the metal plates, including:

a base part in an upper surface of which a groove having a width of 1/2 to 1/1 of signal wavelength of a high frequency signal and a depth approximately equal to 1/4 of the signal wavelength, and whose inner wall is formed of an electrically conductive material, is formed as a waveguide for the high frequency signal; and a moving part formed of an electrically conductive material and placed above the upper surface of the base part in such a manner as to cover the groove, the moving part including a coupling window for an electromagnetic wave of the high frequency signal, the coupling window being positioned above the groove, and a reflecting member that is formed on a lower surface of the moving part in such a manner as to fit in a cross section of the groove and is positioned away from the coupling window by 1/8 to 1/1 of guide wavelength of the high frequency signal, and whose thickness in a longitudinal direction of the groove is not smaller than 1/10 of the guide wavelength, wherein the coupling window and the reflecting member are together movable along the groove in the longitudinal direction, and the electromagnetic wave of the high frequency signal propagated through the waveguide formed by the groove and the lower surface of the moving part is radiated through the coupling window; and a wave collector placed between the metal plates, wherein the phase of the electromagnetic wave of the high frequency signal emitted through the coupling window and converted by the wave collector is varied by varying the position of the coupling window of the primary radiator relative to the wave collector; and a plurality of slots, formed in one of the metal plates of the phase shifter, for coupling the electromagnetic wave to and from the wave collector, wherein a beam direction of the electromagnetic wave to be radiated from the slots is made variable.

12. The beam scanning antenna of claim 11, wherein a directional antenna element is mounted above the slots and the phase-controlled high frequency signal is fed to the antenna element.

* * * * *